United States Patent [19]

Cline et al.

[11] 4,225,636

[45] Sep. 30, 1980

[54] HIGH POROSITY CARBON COATED CIGARETTE PAPERS

[75] Inventors: Warren K. Cline; Stuart W. McCarty, both of Brevard; William F. Owens, Jr., Pisgah Forest, all of N.C.

[73] Assignee: Olin Corporation, Pisgah Forest, N.C.

[21] Appl. No.: 18,738

[22] Filed: Mar. 8, 1979

Related U.S. Application Data

[62] Division of Ser. No. 857,660, Dec. 5, 1977, abandoned.

[51] Int. Cl.[2] ..... B05D 3/02; B05D 5/00; A24D 1/02; A24D 1/08

[52] U.S. Cl. ..... 427/243; 131/1; 131/7; 131/9; 131/15 R; 427/395

[58] Field of Search ..... 131/1, 7, 9, 15 R; 162/139; 282/28 R; 428/323, 326; 427/243, 391, 395

[56] References Cited

U.S. PATENT DOCUMENTS

| | | | |
|---|---|---|---|
| 2,755,207 | 7/1956 | Frankenburg | 131/15 |
| 2,998,012 | 8/1961 | Lamm | 131/15 |
| 3,744,496 | 7/1973 | McCarty et al. | 131/8 |
| 4,112,154 | 9/1978 | McCarty et al. | 427/395 X |

*Primary Examiner*—Michael R. Lusignan
*Attorney, Agent, or Firm*—Robert W. Habel

[57] ABSTRACT

A method for producing high porosity, high carbon content cigarette papers in which a paper substrate having an initial Filtrona porosity of at least 10,000 air permeability units is coated with an aqueous suspension containing from 10 to 50% by weight finely divided carbon, up to 3% by weight of a water-soluble binder, and from 0.5 to 3% by weight of an alkali metal carbonate and thereafter dried resulting in a coated paper having a Filtrona porosity of not less than 5,000 air permeability units. Carbon coated cigarette papers made in accordance with the foregoing method may be used as the inner wrapper for the tobacco column of a cigarette in combination with an outer wrapper of porous or perforated cigarette paper to provide substantial reductions in the constituent yields in the mainstream and sidestream smoke emanating from the cigarette without increasing the carbon monoxide yield obtained in the smoke from the cigatette when compared to conventional cigarettes containing a single wrap of standard cigarette paper.

4 Claims, No Drawings

HIGH POROSITY CARBON COATED CIGARETTE PAPERS

This application is a division of application Ser. No. 857,660 filed Dec. 5, 1977, and now abandoned.

BACKGROUND OF THE INVENTION

1. Field of the Invention

This invention relates generally to cigarettes and the wrappers for the tobacco columns thereof and more particularly to an improved method for obtaining high porosity, high carbon content wrappers for cigarettes which significantly reduce particulate and vapor phase constituents of smoke obtained from the cigarette as well as reducing the amount of visible sidestream smoke that normally emanates therefrom without increasing the carbon monoxide yields obtained in the smoke when compared to cigarettes employing conventional wrappers.

2. Description of the Prior Art

Cigarettes or cigars constructed with an inner wrapper of carbon filled paper surrounding the tobacco column under an outer wrapper of conventional cigarette paper are well known as disclosed and claimed in U.S. Pat. No. 3,744,496. Such carbon filled wrappers are made using an ordinary paper furnish such as wood pulp or flax fiber to which is added a quantity of pulverized carbon as a filler. The furnish of fiber and carbon filler is then used to make paper on a conventional papermaking machine. When made into cigarettes, the combination of carbon filled paper inner wrap and conventional outer wrap results in a reduction of the tobacco weight necessary to make a satisfactory product, increases the tobacco rod firmness, and does not alter the appearance of the cigarette or cigar since the outer wrap of conventional cigarette paper or cigar wrap hides the gray carbon filled inner wrapper. More importantly, such carbon filled wrappers are extremely successful in significantly reducing organic vapor phase components and total particulate matter yields normally found in the smoke from such smoking articles and, in addition, result in a substantial reduction in the visible sidestream smoke that normally emanates from a cigarette or cigar during static burning. While these are very desirable and extremely valuable attributes of such smoking article constructions, they have one disadvantage in that the carbon monoxide yield in the smoke from such cigarette constructions tends to be substantially greater than that found in the smoke from conventional cigarettes wrapped with a single wrap of ordinary cigarette paper. Also, the manufacture of such carbon filled wrappers is messy when produced on conventional Fourdrinier papermaking machines and due to the amounts of carbon that must be used in the paper furnish to obtain a satisfactory product, it is difficult to obtain a product having sufficient tensile strength to be used on cigarette making machines, particularly when the amount of carbon is greater than 20% by weight of the paper. Furthermore, the paper itself tends to continually dust off carbon during normal handling operations.

Composite wrappers for cigarettes have also been disclosed in U.S. Pat. No. 3,395,714 in which the outer wrapper is conventional cigarette paper and the inner wrapper next to the tobacco column is a low temperature melting point heat insulating plastic sheet material. Various metal coated cigarette papers have also been suggested in the prior art as for example in U.S. Pat. No. 3,586,005, which discloses a cigarette paper wrapper in which the paper is coated on either or both surfaces with a thin layer of metal such as aluminum or aluminum based alloys. However, all of these wrappers are nonporous and essentially impervious to air. Therefore, they are unacceptable in cigarette applications where air attenuation in the tobacco column is desired.

Accordingly, it is an object of this invention to provide a method for producing high porosity, high carbon containing paper wrappers which when employed in cigarettes are effective in reducing total particulate matter yields and organic vapor phase constituents in the mainstream smoke while simultaneously reducing the visible sidestream smoke without increasing the carbon monoxide yields when compared to the smoke from conventional cigarettes constructed with ordinary cigarette paper.

SUMMARY OF THE INVENTION

In accordance with this invention, we have discovered a unique method for obtaining a high porosity, high carbon containing paper sheet applicable for use as a cigarette wrapper which comprises coating a paper substrate having a Filtrona porosity of at least 10,000 air permeability units with an aqueous suspension containing from 10 to 50% by weight finely divided carbon, up to 3% by weight of a water-soluble binder, and from 0.5 to 3% by weight alkali metal carbonate and thereafter drying the coated paper to achieve a final Filtrona porosity in the coated paper of not less than 5,000 air permeability units.

Filtrona porosity as used herein means the cubic centimeters of air that will pass through a one-square-centimeter sheet of paper in one minute at 10 centimeters water gauge pressure according to the following formula:

$$\text{Filtrona Porosity} = \frac{\text{cc/min/cm}^2}{\text{10 cm pressure}}$$

The base paper to which the coating is applied can be made from any of the fiber pulps customarily used to make paper wrappers for cigarettes, such as wood or flax fiber, provided the Filtrona porosity of the paper prior to coating is at least 10,000 air permeability units and preferably 17,000 air permeability units or greater. The carbon used in the coating suspension may be either activated or unactivated. Activated carbons are preferred such as activated wood carbons, activated mill waste carbons, and activated coal and petroleum based carbons. Unactivated coal and pulverized charcoal may also be used, although they are not as effective in removing smoke constituents when the resulting coated paper is incorporated in a cigarette. Whatever type of carbon is selected it should be finely pulverized and preferably have an average particle size of 5 microns or smaller in diameter. The preferred binder used in the aqueous carbon suspension is carboxymethyl cellulose, although other water-based binders such as methyl cellulose, hydroxyethyl cellulose, starch, alginates and the like may also be employed. The amount of binder used in the suspension can vary from about 0.1% to about 3% by weight based upon the weight of the suspension.

Incorporation of an alkali metal carbonate in the suspension is a critical feature of the invention since it affects the coating characteristics of the suspension as it is applied to the paper. When carbonate is present in the suspension, the coating goes on smoothly and the resultant carbon coated sheet is uniformly and highly porous. Sodium or potassium carbonates are preferred, and the amount employed in the suspension should be in the range of from 0.5 to 3% and preferably about 0.2% by weight to achieve the desired uniform high porosity in the final coated sheet. In addition, a minimum porosity in the base paper is required in order to obtain a satisfactory product and for successful application of the coating. If the paper structure is insufficiently porous or closed when coated, the existing pores will be bridged over and filled up by the coating resulting in a drastic reduction in the air permeability of the finished sheet. It has been found that a paper having a Filtrona porosity of at least 10,000 air permeability units is essential to achieve the desired end result of a high porosity coated sheet. Preferably, the Filtrona porosity of the uncoated paper should be 17,000 air permeability units or greater. However, even with high porosity uncoated base sheets, it is essential that the aqueous suspension contain a small percentage of the alkali metal carbonate in order to prevent blocking of the sheet during coating. Without the carbonate present in the coating slurry, the pores in the paper tend to be bridged over resulting in a nonuniformly porous sheet and a drastic reduction in air permeability.

The method of the invention can be used to apply the coating suspension to one or both surfaces of the porous paper substrate depending upon the amount of carbon desired on the finished sheet. Amounts of carbon on the coated sheet may range from 5 to 90% by weight based on the weight of the paper. However, the method of the invention enables high amounts of carbon to be applied to the paper, for example 20% or greater, without adversely affecting the physical properties of the paper such as tensile strength. The coating suspension may be applied to the paper using any conventional coating techniques such as by size-press rollers on the paper machine, roll coaters, gravure coaters, fountain coaters and the like. After coating, the paper is conventionally dried. The finished coated sheet must have a Filtrona porosity of not less than 5,000 air permeability units. The coated paper product thus produced exhibits good adhesion of carbon to paper unlike the dusty carbon filled papers made by the heretofore known process. When the coated paper is rubbed between the fingers it shows little tendency to slough off carbon. It also has better strength characteristics having both higher tensile strength and greater elongation at break than the untreated paper and much higher than paper made with a similar amount of carbon incorporated as a filler in the paper furnish. When the coated papers are incorporated as an inner wrap for a cigarette under a conventional outer wrap of cigarette paper in a smoking article, they produce significant decreases in visible sidestream smoke as well as reducing the particulate matter and organic vapor phase constituents in the mainstream smoke and, quite surprisingly, do not increase the carbon monoxide yields from the smoke of the cigarette. Furthermore, the method of this invention allows application to the base paper of large amounts of carbon giving good adhesion to the paper without appreciably reducing the effectiveness of the carbon in modifying the smoking characteristics of the cigarette. The presence of the water-soluble binder in sufficient quantities to achieve adhesion of the carbon to the paper does not impair contact of smoke components with the carbon during combustion of the cigarette and enables the application of large amounts of carbon to the paper and actually improves the strength and other physical characteristics of the product.

PREFERRED EMBODIMENTS

Typical results demonstrating the effects obtained in accordance with this invention are described in the following examples which are illustrative of the invention only and not in limitation thereof.

A variety of aqueous slurries containing various percentages of activated carbon, carboxymethyl cellulose and sodium carbonate were prepared and used to coat one side of several types of base papers having different Filtrona porosities prior to coating. The aqueous slurries in each case were made up of activated wood charcoal having an average particle size of about 5 microns or less. A relatively low molecular weight grade of carboxymethyl cellulose, sold under the trade name Hercules CMC 7L3T, was used in all slurry compositions. All slurry compositions were applied to the paper using a No. 8 Meyer rod to draw down the coating. After application of the coating, the sheets were air dried and the Filtrona porosity of the coated sheets determined. Sample cigarettes were prepared using the carbon coated paper as the inner wrapper for the tobacco column and a standard cigarette paper having a minimum Filtrona porosity of about 240 air permeability units as the outer wrapper. All sample cigarettes were 70 mm in length and approximately 8 mm in diameter. For control purposes, identical cigarette samples were prepared without the carbon coated paper inner wrap using the same tobacco and standard cigarette paper having a Filtrona porosity of 25 air permeability units. Additional control cigarettes were made using the same tobacco and an uncoated inner wrapper of the same porosity with an outer wrapper identical to that used in the test samples. The following table sets forth the results obtained for the various samples and properties measured compared with the control cigarettes based upon the constituent yields in the smoke obtained from burning 60 mm of the tobacco column of each cigarette.

| Cig. Sample No. | Base Paper Filtrona Porosity | Coating Slurry % by Wt. Carbon | CMC | $Na_2CO_3$ | % Carbon by Wt. of Coated Paper | CO Coated Paper Filtrona Porosity | Yield in Smoke (mg/cig) | Side-stream Particulate Yield (mg/cig) |
|---|---|---|---|---|---|---|---|---|
| Control | Not used | | None used | | N/A | N/A | 17.5 | 25.0 |
| Control | 210,000 | | None used | | N/A | N/A | 12.2 | 25.9 |
| 1 | 210,000 | 0 | 1.0 | 0 | 0 | 100,000 | 12.1 | 25.7 |
| 2 | 210,000 | 2.5 | 0.2 | 2 | 20 | 42,000 | 11.6 | 22.9 |
| 3 | 210,000 | 2.5 | 1.0 | 2 | 26 | 42,000 | 11.3 | 23.0 |
| 4 | 210,000 | 25.0 | 1.0 | 2 | 47 | 105,000 | 16.1 | 19.3 |
| 5 | 210,000 | 15.0 | 0.6 | 2 | 49 | 42,000 | 11.7 | 20.0 |

-continued

| Cig. Sample No. | Base Paper Filtrona Porosity | Coating Slurry % by Wt. Carbon | CMC | $Na_2CO_3$ | % Carbon by Wt. of Coated Paper | CO Coated Paper Filtrona Porosity | Yield in Smoke (mg/cig) | Side-stream Particu-late Yield (mg/cig) |
|---|---|---|---|---|---|---|---|---|
| 6 | 17,000 | 15.0 | 0.6 | 2 | 48 | 21,000 | 11.2 | 18.7 |
| 7 | 17,000 | 15.0 | 0.6 | 2 | 36 | 9,130 | 15.5 | 19.2 |
| 8 | 30,000 | 25.0 | 1.0 | 2 | 47 | 9,130 | 15.0 | 18.8 |
| 9 | 17,000 | 15.0 | 0.6 | 2 | 46 | 4,290 | 18.5 | 18.5 |
| 10 | 17,000 | 25.0 | 1.0 | 2 | 47 | 3,140 | 23.7 | 19.4 |
| 11 | 17,000 | 25.0 | 1.0 | 2 | 49 | 1,960 | 24.8 | 19.2 |
| 12 | 17,000 | 25.0 | 1.0 | 2 | 49 | 1,235 | 26.4 | 18.0 |

As the results set forth in the above table clearly shown, the carbon monoxide yields in the smoke from cigarettes using the carbon coated inner wrapper made in accordance with the method of this invention are less or equivalent to the carbon monoxide yield from the control cigarettes without the inner wrapper or those with an uncoated inner wrapper provided the Filtrona porosity of the carbon coated inner wrapper is greater than about 5,000 air permeability units. When the Filtrona porosity is less than about 5,000 air permeability units, carbon monoxide yields rise significantly and are substantially greater than that obtained in the smoke from the control cigarettes.

It has also been found that in order to obtain the desired Filtrona porosity in the carbon coated paper it is necessary to use a base paper having a minimum Filtrona porosity of at least 10,000 air permeability units and, as the above results show, a minimum of 17,000 air permeability units is preferred. As expected, those cigarettes constructed with the carbon coated inner wrapper yield much less sidestream particulate matter than either the control cigarettes or the cigarettes having an inner wrapper coated solely with carboxymethyl cellulose. Mainstream smoke components were similarly reduced, although not shown. However, in order to obtain carbon monoxide yields equivalent to or lower than the control cigarettes, the carbon coated inner wrapper must have a final coated Filtrona porosity of at least 5,000 air permeability units. Tensile strengths of all the carbon coated papers were increased over the uncoated base sheet and substantially greater than those in heretofore used carbon filled papers. Thus, the coating method of the invention enables the production of high carbon content papers with tensile strength equivalent to or better than conventional cigarette paper such that the paper can be used effectively on standard cigarette making machines.

Although the invention has been described in conjunction with the foregoing specific examples and preferred embodiments, they are only illustrative of the invention and it is to be understood that there are many variations and modifications that may be resorted to without departing from the spirit and scope of the invention, as those skilled in the art will readily understand.

What we claim is:

1. A method for producing high porosity, high carbon content cigarette paper comprising uniformly coating at least one surface of a paper substrate having a Filtrona porosity of at least 10,000 air permeability units with an aqueous slurry containing from 10 to 50% finely divided carbon, from 0.1 to 3% of a water-soluble binder, and from 0.5 to 3% of an alkali metal carbonate, all percentages by weight based on the weight of the slurry, and drying the coated paper to obtain a finished coated paper having a Filtrona porosity of not less than 5,000 air permeability units.

2. The method of claim 1 in which the Filtrona porosity of the paper substrate is at least 17,000 air permeability units.

3. The method of claim 1 in which the aqueous slurry contains about 2% alkali metal carbonate.

4. The method of claim 1 in which the alkali metal carbonate is sodium or potassium carbonate and the water-soluble binder is selected from the group consisting of carboxymethyl cellulose, hydroxyethyl cellulose, starch and alginates.

* * * * *